US007361439B2

(12) United States Patent
Wilbert et al.

(10) Patent No.: US 7,361,439 B2
(45) Date of Patent: Apr. 22, 2008

(54) LATHE SURFACE FOR COATING STREAK SUPPRESSION

(75) Inventors: Thomas M. Wilbert, Wolcott, NY (US); Gary J. Maier, Webster, NY (US); William G. Herbert, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 481 days.

(21) Appl. No.: 11/026,036

(22) Filed: Jan. 3, 2005

(65) Prior Publication Data

US 2006/0147824 A1 Jul. 6, 2006

(51) Int. Cl.
*G03G 5/14* (2006.01)

(52) U.S. Cl. ..... 430/65; 430/69; 430/131

(58) Field of Classification Search ..... 430/65, 430/69, 131

See application file for complete search history.

(56) References Cited

U.S. PATENT DOCUMENTS

| | | | | |
|---|---|---|---|---|
| 4,800,144 | A * | 1/1989 | Ueda et al. | 430/65 |
| 5,003,851 | A | 4/1991 | Kawada et al. | |
| 5,170,683 | A | 12/1992 | Kawada et al. | |
| 5,228,369 | A | 7/1993 | Itoh et al. | |
| 5,309,200 | A | 5/1994 | Michlin | |
| 5,346,556 | A | 9/1994 | Perry et al. | |
| 5,381,213 | A | 1/1995 | Michlin | |
| 5,573,445 | A | 11/1996 | Rasmussen et al. | |
| 5,635,324 | A | 6/1997 | Rasmussen et al. | |
| 5,891,594 | A | 4/1999 | Yuh et al. | |
| 5,919,594 | A | 7/1999 | Perry et al. | |
| 5,958,638 | A | 9/1999 | Katayama et al. | |
| 5,997,722 | A | 12/1999 | Vidal et al. | |
| 6,051,148 | A | 4/2000 | Perry et al. | |
| 6,331,371 | B1 | 12/2001 | Matsui | |
| 2004/0053151 | A1 * | 3/2004 | Hashimoto et al. | 430/69 |

* cited by examiner

*Primary Examiner*—Christopher RoDee
(74) *Attorney, Agent, or Firm*—Oliff & Berridge, PLC

(57) ABSTRACT

A photoreceptor aluminum alloy substrate is prepared with specific roughness characteristics and an oxide layer for use in multi-layered electrophotographic photoreceptor. A photoreceptor substrate, or drum, is placed in a lathe and turned using a polycrystalline tool to achieve specific roughness characteristics. A oxide layer is then allowed to form on the roughened photoreceptor substrate. The roughened surface of the photoreceptor aluminum alloy substrate in conjunction with the oxide layer on the roughed surface reduces variances in surface energy across the photoreceptor substrate, and eliminates, or greatly reduces, a number of Tiger Stripe and Tiger Tail defects that may occur in an undercoat layer subsequently applied to the roughened photoreceptor substrate. The approach eliminates the need for wet honing and thereby significantly reduces the complexity and cost of fabricating a multi-layered electrophotographic photoreceptor.

17 Claims, 5 Drawing Sheets

LATHE SURFACE FOR COATING STREAK SUPPRESSION

BACKGROUND

Photoreceptors are used in printing/copying devices. In particular, the manufacture of a photoreceptor substrate with a more evenly distributed surface energy is described.

In xerography, or electrophotographic printing/copying, a charge-retentive device called a photoreceptor is electrostatically charged. For optimal image production, the photoreceptor should be uniformly charged across its entire surface. The photoreceptor may then be exposed to a light pattern of an input image to selectively discharge the surface of the photoreceptor in accordance with the image. The resulting pattern of charged and discharged areas on the photoreceptor forms an electrostatic charge pattern (i.e., a latent image) conforming to the input image. The latent image may be developed by contacting it with finely divided electrostatically attractable powder called toner. Toner may be held on the image areas by electrostatic force. The toner image may then be transferred to a substrate or support member (e.g., paper) and the image may then be affixed to the substrate or support member by a fusing process to form a permanent image thereon. After transfer, excess toner left on the photoreceptor may be cleaned from the photoreceptor surface and residual charge may be erased from the photoreceptor.

Electrophotographic photoreceptors may be provided in a number of forms. For example, a photoreceptor may be a homogeneous layer of a single material, such as vitreous selenium, or a photoreceptor may be a composite layer containing a photoconductive layer and another material. In addition, the photoreceptor may be multi-layered. Current layered photoreceptors generally have at least a flexible substrate support layer, or undercoat layer (UCL), and two active layers. These two active layers generally include a charge generating layer (CGL) containing a light absorbing material, and a charge transport layer (CTL) containing electron donor molecules. These layers may be in any order, and sometimes may be combined in a single or a mixed layer. The flexible substrate support layer may be formed of a conductive material. Alternatively, a conductive layer may be formed on top of a nonconductive flexible substrate support layer.

U.S. Pat. No. 5,958,638 to Katayama, et al. discloses exemplary known materials used for undercoat layers. For example, such materials may include a resin material alone, such as polyethylene, polypropylene, polystyrene, acrylic resin, vinyl chloride resin, vinyl acetate resin, polyurethane, epoxy resin, polyester, melamine resin, silicone resin, polyvinyl butyryl, polyamide and copolymers containing two or more of repeated units of these resins. The resin materials may further include casein, gelatin, polyvinyl alcohol, ethyl cellulose, etc. The undercoat layers are typically formed by a dip coating method. See, for example, U.S. Pat. No. 5,958,638 and U.S. Pat. No. 5,891,594 to Yuh, et al. In an exemplary dip coating process, a cylindrical drum may be dipped into a tank of coating material and then withdrawn, with a portion of the coating material adhering to the drum. The adhered coating material is then allowed to cure.

U.S. Pat. No. 6,331,371 to Matsui describes an electrophotographic photoreceptor that has a conductive support and a photoconductive layer laminated on the conductive support. A described exemplary conductive support is made of aluminum or aluminum based alloy, and the maximum height of the surface roughness of the conductive support is 0.8 μm or more and 2.0 μm or less. Further, the reflectivity of light incident upon the surface of the conductive support is equal to or less than 35% of a quantity of exposure light from a coherent light. The described photoreceptor produces a quantity of reflected lights in response to a coherent light and thereby suppresses a quantity of interference lights produced by the reflected lights and reflected lights from or incident lights on the photoconductive layer. In this manner the photoreceptor prevents generation of interference fringe patterns upon printed output.

U.S. Pat. No. 6,051,148 to Perry et al. describes a method of fabricating a multi-layered photoreceptor in which a photoreceptor substrate having a metal surface is etched with an etching solution and a metal oxide layer is formed on the metal surface with the etching solution. The etching and oxidation layer creates a roughened substrate surface that scatters rather than reflects light. This light scatter effect reduces interference patterns caused by reflected beams of coherent light reflected from each of the respective interfaces between layers in the multi-layered photoreceptor.

U.S. Pat. No. 5,997,722 to Vidal et al. describes an aqueous cleaning method for a photoreceptor that includes analyzing the finished substrate surface by performing a first surface energy reading, a first ellipsometry reading, a first x-ray diffraction reading, and a first profilometry reading, removing electrochemically via an alternating voltage or alternating current a portion of the finished substrate surface, thereby resulting in a cleaned substrate surface, analyzing the cleaned substrate surface by performing a second surface energy reading, a second ellipsometry reading, a second x-ray diffraction reading, and a second profilometry reading, in which the removing step is accomplished to the extent that the second surface energy reading and the second ellipsometry reading are measurably changed from the first surface energy reading and the first ellipsometry reading, but the second x-ray diffraction reading and the second profilometry reading are measurably unchanged from the first x-ray diffraction reading and the first profilometry reading; and depositing a layer of the photoreceptor on the cleaned substrate surface.

U.S. Pat. No. 5,635,324 to Rasmussen et al. describes a method for eliminating interference between the photoreceptor substrate and the undercoat layer interface, the substrate is formed to include a surface texture that is optimal for enabling continuous coating of thin-film forming undercoat layer materials such as organometallic or organometallic chelate compounds with a silane having a dried coated thickness between approximately 0.05-0.5 μm and preferably between 0.08-0.12 μm. In order for the substrate to accommodate a thin layer of such undercoat materials, the substrate of the photoreceptor is designed to have a specific surface roughness.

U.S. Pat. No. 5,381,213 to Michlin describes an adapter that allows a lathe to turn photoreceptor substrate drums, charge rollers and developer brushes of printers, copiers, and facsimile machines. A unitary component adapts the drum so it may be held on the lathe and drives the object. The adapting portion includes a flexible material such as a hose or o-ring to snugly receive the end extension of the drum, roller or brush. The drive portion connects with the drive bolt of the lathe and spins the object.

U.S. Pat. No. 5,346,556 to Perry et al. describes a method of cleaning a substrate that includes: lathing a substrate surface with a cutting fluid composition containing an antioxidant, a surfactant, a lubricant, and water; rinsing the lathed substrate surface with high quality deionized water having a resistivity of at least 2 M ohm-cm; immersing the rinsed lathed substrate surface in a bath of high quality deionized water having a resistivity of at least 2 M ohm-cm; and removing the substrate from the bath of deionized water at a rate low enough to prevent water droplets from forming on the substrate.

U.S. Pat. No. 5,309,200 to Michlin describes a set of adapter units which allow a powerful, variable speed lathe to turn photoreceptor drums, charge rollers and developer brushes of printers, copiers, and facsimile machines. In one embodiment, adapter units fit over the cylindrical extensions on the ends of the drum. Two pieces of opposing tail stock support and hold the drum on the lathe by applying pressure against the adapter units. A drive bushing is attached to and rotates with the drive bolt of the lathe.

U.S. Pat. No. 5,228,369 to Itoh et al. describes a method for machining a substrate surface of a photoreceptor by the use of a cutting machine which supplies cutting lubricant from a reservoir to a cutting tool of the cutting machine, the method comprises a measurement of the cutting tool temperature by a sensor and a control of both the temperature of cutting lubricant and a flow rate thereof. The control is responsive to the cutting tool temperature and suppresses a temperature fluctuation of the cutting tool.

U.S. Pat. No. 5,170,683 to Kawada et al. describes a method of surface-processing a photoreceptor base including aluminum material for electrophotography on a lathe. A surface of the a photoreceptor base is cut by a cutting tool having a polycrystalline diamond body while cutting fluid, composed of water, an aqueous solution of a surface-active agent or an aqueous solution of a water-soluble organic solvent, is supplied to the surface of the photoreceptor base.

U.S. Pat. No. 5,003,851 to Kawada et al. describes a method of manufacturing a photoreceptor base drum by a lathe-turning machine in which a cutting tool is brought in contact with a surface of the base drum and travels in the axial direction to finish the surface of the base drum into a mirror-like surface. A main cutting edge formed by a rake surface and a front flank surface on the cutting tool is shaped as a curved surface with a radius of curvature of 0.15 to 3.5 μm, and the rake surface and the front flank surface are shaped to smoothly continue to the curved surface of the main cutting edge.

U.S. Pat. No. 5,919,594 to Perry et al. and U.S. Pat. No. 5,573,445 to Rasmussen et al. describe methods of roughening a photoreceptor substrate by spraying a honing composition including a particulate matter against a photoreceptor substrate to create a predetermined surface roughness.

All of the references indicated above are herein incorporated by reference in their entirety for their teachings.

SUMMARY

In the fabrication of a multi-layered electrophotographic photoreceptor, a photoreceptor aluminum alloy substrate is prepared with specific roughness characteristics and an oxidation layer resulting in a photoreceptor substrate with a more evenly distributed surface energy. By creating a photoreceptor substrate with a more evenly distributed surface energy, axial streaks (referred to as Tiger Stripe and/or Tiger Tail defects ) that typically occur in an undercoat layer (UCL) subsequently applied to the photoreceptor substrate may be eliminated, or greatly reduced.

In accordance with one exemplary process, a photoreceptor aluminum alloy substrate, or drum, is placed in a lathe and turned using a polycrystalline diamond cutting tool. The resulting turned photoreceptor substrate has a surface that may be characterized by a roughness profile in which $R_a$ is between 0.060 μm and 0.400 μm (preferably between 0.080 μm and 0.200 μm), $R_t$ (0.100) is a minimum of 100 counts, but preferably 200-500 counts or greater, $R_t$ (0.400) is less than 150 counts, but preferably zero counts, and $R_{max}$ is not greater than 4.0 μm but preferably less than 1.0 μm.

Such roughness profile characteristics may be determined for an evaluation length (e.g., 0.8 mm) measured across the photoreceptor substrate surface in an axial direction. $R_a$ is the arithmetic average of all departures of the roughness profile from a center line within the evaluation length. $R_{max}$ represents the largest single roughness gap within the evaluation length. $R_t$ (0.100) is a count of peak to valley distances that are at least 0.100 μm. $R_t$ (0.400) is a count of peak to valley distances that are at least 0.400 μm.

In such an exemplary photoreceptor substrate, if the $R_{max}$ is greater than 2.0 μm, circumferential lines may show during print tests using the finished photoreceptor. Also, if the $R_t$ (0.100) count is less than 100, there may be little reduction in the number and severity of observed axial streaks.

Using the described approach, a specific surface roughness may be achieved upon a photoreceptor substrate surface without the need to wet hone the surface of the photoreceptor drum as described above with respect to U.S. Pat. No. 5,919,594 to Perry et al. and U.S. Pat. No. 5,573,445 to Rasmussen et al. Thus, one of the many advantages is the elimination of the need for wet honing, which may significantly reduce the complexity and cost of fabricating multi-layered electrophotographic photoreceptors.

DETAILED DESCRIPTION

Figure 1A:
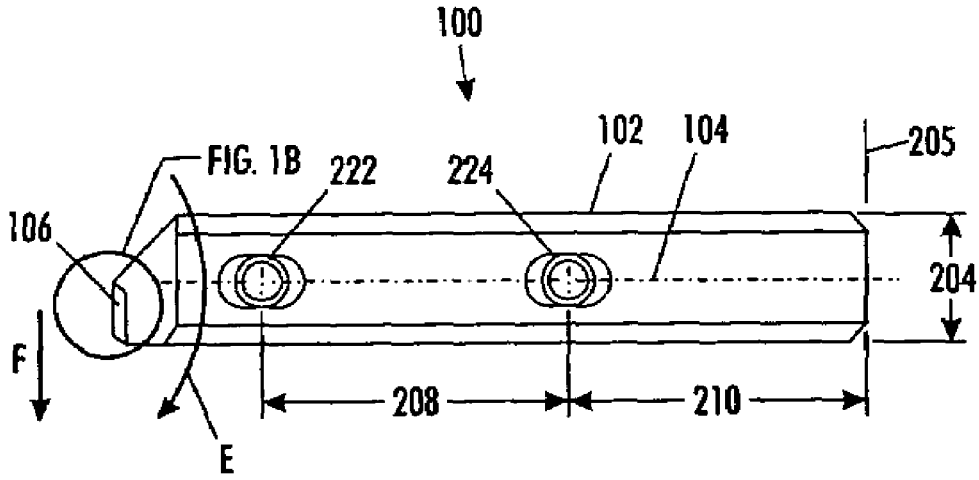
FIG. 1A is a plan view of an exemplary polycrystalline diamond-tipped cutting tool for use in a lathe.

Fabrication of an exemplary multi-layered electrophotographic photoreceptor may begin with an aluminum alloy drum that is approximately 340 mm in length with a diameter of 30 mm. The first layer, an undercoat layer (UCL) used as an electrical and blocking layer, may be applied using dip coating technology. A "three-component" UCL containing polyvinyl butyral (6 weight percent), zirconium acety acetonate (83 weight percent) and gamma-aminopropyl triethoxy silane (11 weight percent) may be mixed, in the order listed, with n-butyl alcohol in 60:40 (by volume) solvent to solute weight ratio for the UCL. The UCL may be applied in a thickness of approximately 0.05 to 2.0 μm (preferably 0.05 to 1.0) to the aluminum alloy drum substrate by dip coating. The substrate may next coated with about 0.2 μm thick charge generating layer (CGL) of hydroxygallium phthalocyanine (OHGaPC) and a terpolymer VMCH available from Union Carbide of: vinyl chloride (83 weight percent), vinyl acetate (16 weight percent) and maleic anhydride (1 weight percent), dissolved in n-butyl acetate (4.5 weight percent solids) in a 60:40 weight ratio (60 OHGaPC: 40 VMCH). The CGL may be subsequently coated with a 24 μm thick (after drying) charge transport layer (CTL) of polycarbonate derived from bis phenyl Z (PCZ, available from Mitsubishi Chemicals) and N,N'-diphenyl-N,N'-bis(3-methylphenyl)-(1,1'-biphenyl)-4,4' diamine dissolved in tetrahydrofuran.

After producing an electrophotographic photoreceptor as described above, defects have been identified in the dried surface of the three-component UCL applied to the photoreceptor substrate. This defect may include a characteristic light diffraction pattern around the top of the UCL coating, similar in appearance to the stripes on the back of a tiger (Tiger Stripes) that would often droop down the surface of the photoreceptor substrate (Tiger Tails) as a streak in the UCL coating. A typical photoreceptor device produced as described above may include several of these streaks (often more than eight). These defects were most likely to occur in the coating positions where the solvent vapor above the dip tank was the highest. The presence of such solvent vapors may retard solvent flash off and drying, thus, promoting and prolonging the mobility of the UCL coating.

Print tests using the resulting photoreceptor devices produce printed output that includes objectionable streaks that match the, so called, Tiger Tails in the photoreceptor undercoat layer. Optimization of the coating process (e.g., improved ventilation of solvent vapors above the dip tanks, etc.) succeeded in reducing the severity of the Tiger Stripe and Tiger Tail defects, however, rejection rates due to the presence of Tiger Tails in finished photoreceptor device remained unacceptably high.

Analysis of the Tiger Stripe and Tiger Tail problem determined that the defects are caused by uneven surface energy present upon the surface of the photoreceptor substrate. The processes used to prepare the raw aluminum alloy tube to become a photoreceptor UCL substrate produces streaks of aluminum alloy with differing average grain size and orientation. These streaks run in the axial direction and may be easily seen after etching the raw tube or etching the lathed tube. For example, these streaks may occur in numbers exceeding thirty on a 30 mm diameter photoreceptor substrate. While the, so called, weld lines (four on a typical aluminum alloy photoreceptor substrate) are counted as part of this number of streaks, the total number of streaks exceed the number of weld lines by a factor of about ten.

Each of the surface energy streaks upon the surface of a photoreceptor substrate may have a unique surface energy. Measurements using a standard water droplet technique reveal that the energy difference may be considerable (tens of dynes per centimeter) between the streaks. Further, the boundaries between these streaks are well defined when the tube is mirror lathed.

A solution wets a surface when the surface has a higher surface energy than the solution because the higher energy surface literally pulls the lower surface energy solution over the surface. When the situation is reversed, the higher surface energy liquid will tend to form droplets on a lower surface energy surface. Three component UCL, as described above, has a relatively low surface energy, thus, the three component UCL has a strong propensity to wet the photoreceptor substrate.

However, if the photoreceptor substrate has bands of surface energies with well-defined borders, the three component UCL may be disproportionately pulled toward the substrate areas with higher surface energy. This disproportionate pull may cause some areas of the substrate to have a thinner layer of UCL next to areas with thicker UCL. This is especially the case when areas of higher surface energy flank an area of relatively low surface energy. When the flash-off time and the drying time are extended, there will be more time for this movement, thus, thinning to occur. When this thinning is sufficient, print defects will result.

Investigation of the problem further revealed that changing the roughness of the aluminum alloy substrate surface and forming an oxide layer on the roughened substrate surface mitigated the propensity of Tiger Stripe and Tiger Tail defects. A roughened surface and an oxide layer blur the borders between the higher and lower surface energy areas, thus, mitigating the severity of the differences in surface energy. Additionally, extra oxide thickness may be obtained on some substrate surfaces without extraordinary means because of an increased surface energy of the substrate surface resulting from the mechanical working associated with the roughening of the substrate surface. For example, a honed substrate demonstrates very little propensity to form Tiger Stripes and no propensity to form Tiger Tails. However, the honing process introduces a considerable amount of energy to the surface of the substrate and this energy promotes the formation of the oxide layer.

Substrate surfaces that are lathed with progressively rougher surfaces experience a similar drop in the propensity to form these defects. This reduction is directly proportional to how closely the lathed surface characteristics emulated a honed surface. Further, it was noted that a rough lathed surface produced using a composite diamond having surface roughness characteristicsin the range of a typical honed surface behaved very much like a honed surface regarding these "Tiger" defects. A honed-like rough lathed surface used in a manner that does not allow the growth of an oxide layer may display a propensity to form Tiger Tails. However, removing the cutting fluid/coolant from this rough lathed surface and subsequently letting it rest at normal ambient conditions, thus allowing an oxide layer to form on the surface of the rough lathed surface, resulted in a rough lathed tube that performs in a manner that is substantially identical to a honed surface. That is, the surface roughness characteristics described above may not be sufficient to eliminate these "Tiger" defects. However, the specified roughness characteristics plus an oxidation layer is sufficient to eliminate the "Tiger" defects.

When substrates having varying levels of surface roughness were exposed to conditions that would increase the thickness of the oxide, a further reduction in "Tiger" type defects is observed. The conditions used to increase the oxide thickness may include, one hour at 140° C. in an oven, anodizing (0° C. in 30% $H_2SO_4$ for 15 min. @ 24V, 16V, & 12V and 15° C. in 1% Citric Acid for 15 min. @ 12V & 16V) and one hour in an oven at 140° C. with an increased $O_2$ (50% versus 20% normally present in air). Some level of oxide thickness may be sufficient to eliminate these "Tiger" defects but process that use conditions where the oxide forms naturally (e.g., allowing the roughened substrate to rest at ambient temperature) are preferred due to the greater simplicity associated with the process.

Based upon this analysis it has been determined that by preparing a photoreceptor substrate with specific roughness characteristics and an oxide layer, as described above, Tiger Stripe and Tiger Tail defects may be greatly reduced or eliminated. However, no single roughness parameter is sufficient to fully specify the surface roughness required. In addition, although the oxide layer covers substantially 100% of the roughened substrate surface, geometric leveling of the oxide layer upon the roughened substrate surface may lead to slight variances in the thickness of the oxide layer at specific points on the substrate surface. Further, all traces of Tiger Stripe and/or Tiger Tail defects do not need to be eliminated because less prominent "Tiger" defects do not affect the operational printing characteristics of the resulting photoreceptor device. For example, Tiger Tails, as described above, typically affect the operational printing characteristics of the photoreceptor, but Tiger Stripes may not.

The process described below teaches how to obtain a surface that will not form offending Tiger Tail defects despite use of a photoreceptor aluminum alloy substrate that has areas with surface energy differences. For example, in accordance with one exemplary process, a photoreceptor aluminum alloy substrate surface may be placed in a lathe and turned using a polycrystalline cutting tool. Typically, the substrate is cylindrical or drum-shaped, and may be cleaned by any suitable technique prior to and after lathing to remove any foreign substances introduced to the surface during any of the aforementioned rough manufacturing processes. The resulting turned photoreceptor substrate preferably has a surface that may be characterized by a rougluless profile in which $R_a$ is between 0.060 μm and 0.400 μm (preferably between 0.080 μm and 0.200 μm), $R_t$ (0.100) is a minimum of 100 counts, but preferably 200-500 counts or greater, $R_t$ (0.400) is less than 150 counts, but preferably zero counts, and $R_{max}$ is not greater than 4.0 μm but preferably less than 1.0 μm. If the $R_{max}$ is too high circumferential lines may show during print testing. Also, if the $R_t$ (0.100) counts are too low there is no effect on the axial streaks.

Such roughness profile characteristics may be determined for an evaluation length (e.g., 0.8 mm) measured across the photoreceptor substrate surface in an axial direction.

$R_a$ is the arithmetic average of all departures of the roughness profile from the center line within a sample length (e.g., 0.8 mm). $R_a$ is defined by a formula:

$$R_a = \frac{1}{l_m}\int_0^{l_m} |y|\, dx \qquad \text{Equation 1}$$

in which $l_m$ represents the evaluation length, and |y| represents the absolute value of departures of the roughness profile from the center line. That is, $R_a$ is the arithmetic average of all departures of the roughness profile from a center line within the evaluation length. The expression $R_{max}$ represents the largest single roughness gap within the evaluation length. $R_t$ (0.100) is a count of peak to valley distances that are at least 0.100 μm. $R_t$ (0.400) is a count of peak to valley distances that are at least 0.400 μm.

Significant suppression of operational effect of Tiger Stripes and Tiger Tail defects may be observed in embodiments of the present invention in which the finished photoreceptor is used within a copying/printing device that uses conventionally used light source wavelengths, including a light source having a wavelength at 780 nm. For example, the photoreceptor device produced according to the invention may be tested for print quality assessment in a Xerox Document Centre 230 (a multifunction laser printing machine) at an initial charging voltage of about 480 volts. The Document Center 230 has a 780 nm wavelength laser diode as the exposure source and a single component discharged area development (DAD) system with 7 μm toner. Interference fringe effect is tested in a gray scale print mode using specified halftone patterns. Distortions in printed output are not observed with photoreceptors that include a UCL substrate with the identified roughness characteristics and oxidation layer. Similar results may be achieved with other laser-based machines, e.g., those with an exposure light source that operates in the range of 600-800 nm.

All measurements of the various surface roughness parameters described herein may be made with a profilameter such as Perthen Model S3P or Model S8P manufactured by Mahr Feinpruef Corporation. Generally, a stylus with a diamond tip is traversed over the surface of the roughened substrate at a constant speed to obtain all data points within an evaluation length of 0.8 mm. The radius of the stylus used to obtain all data referred to herein is 2.5 μm.

An exemplary photoreceptor aluminum alloy substrate, or drum, may be an aluminum tube, approximately 1 mm thick, produced by a drawing method or extrusion method, and cut to a prescribed length (for example 340 mm). The photoreceptor drum may be turned in a lathe in any manner, (e.g., as described in U.S. Pat. No. 5,003,851, described above). Further, the photoreceptor drum may be securely within the lathe may include use of lathe adapters, as described in U.S. Pat. Nos. 5,381,213 or U.S. Pat. No. and 5,346,556, described above. Still further, any of the techniques taught in any of the U.S. patent applications incorporated by reference, above, may be used to facilitate the process described here to obtain a photoreceptor substrate with the roughness characteristics and oxidation layer, as described above.

A lathe cutting tool with a polycrystalline diamond cutting tip may be used to apply the desired roughness characteristics to a photoreceptor substrate surface. One commercially available polycrystalline diamond material suitable for use in such a lathe tool cutting tip is manufactured by K&Y Diamond Ltd., with offices located in St-Laurent, Qc, Canada and Mooers, N.Y., U.S.A. Several polycrystalline diamond materials are available from K&Y Diamond Ltd., each identified as coarse, medium and fine, respectively. The K&Y polycrystalline diamond material found most suitable for use in applying the desired roughness characteristics is marketed as K&Y's "fine" grade polycrystalline diamond material. The polycrystalline diamond material includes a fine grade polycrystalline diamond powder held together by a strong bonding agent.

Figure 2A:
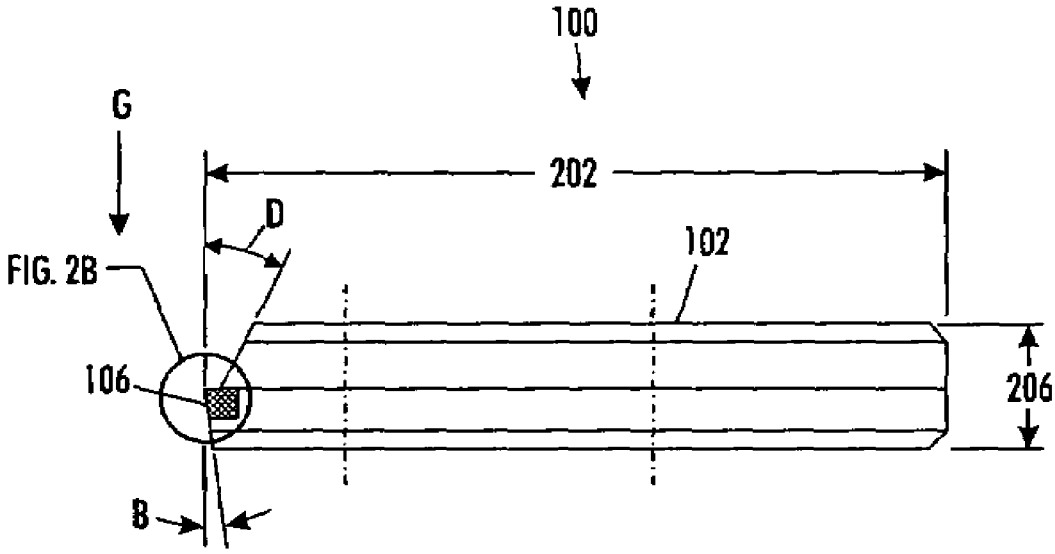
FIG. 2A is a side elevation view of the exemplary polycrystalline diamond-tipped cutting tool shown in FIG. 1A.

FIG. 1A and FIG. 2A present top and side views, respectively, of an exemplary polycrystalline diamond-tipped cutting tool 100 for use in a lathe. Lathe tool 100 may be used in conjunction with the operational parameters, described below, to place a roughened surface upon an aluminum photoreceptor drum substrate that has the desired roughness characteristics needed to reduce Tiger Stripe and/or Tiger Tail defects in a subsequently applied photoreceptor undercoat layer (UCL).

As shown in FIG. 1A and FIG. 2A, the exemplary lathe may include a shank 102 with width 204, height 206, and vertical holes 222 and 224. The lathe tool shank and vertical holes allows the lathe tool to be securely mounted within a lathe using clamps that grip the lathe tool shank and/or pins that align with the vertical holes. The lathe tool shank may include a standard clearance 208 between vertical holes 222 and 224 and a standard offset from rear shank face 205 to hole 224. Use of such standard offsets may be to facilitate alignment of the lathe tool within the lathe. The edges of the substantially rectangular, exemplary lathe tool shank 102 may be beveled (e.g., 1.5 mm at 45°) to remove sharp shank edges. Lathe tool 100 maybe of any size. One exemplary lathe tool may have a length 202 (i.e., from measurement form the outer most edge of cutting tip 106 to rear shank face 205) of approximately 46 mm, a shank width 204 of 7.92 mm and a shank height 206 of 7.92 mm. Such an exemplary lathe tool shank may have a diagonal dimension 220 (i.e., the dimension from one beveled corner face to the to the beveled face of the opposite corner) of 9.4 mm (See FIG. 3).

Figure 1B:
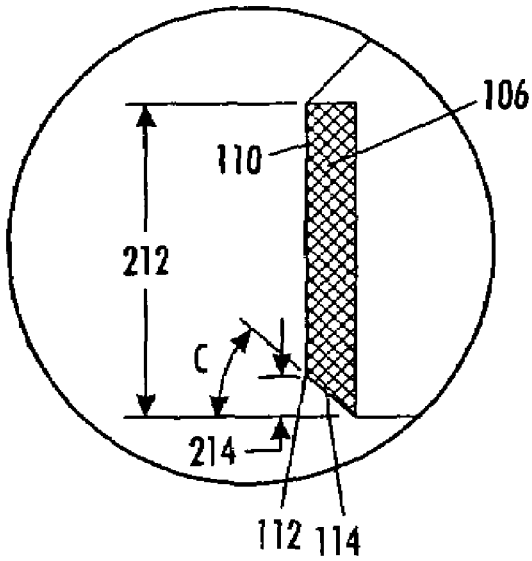
FIG. 1B is a detail view of the tip of the lathe tool shown in FIG. 1A.
Figure 2B:
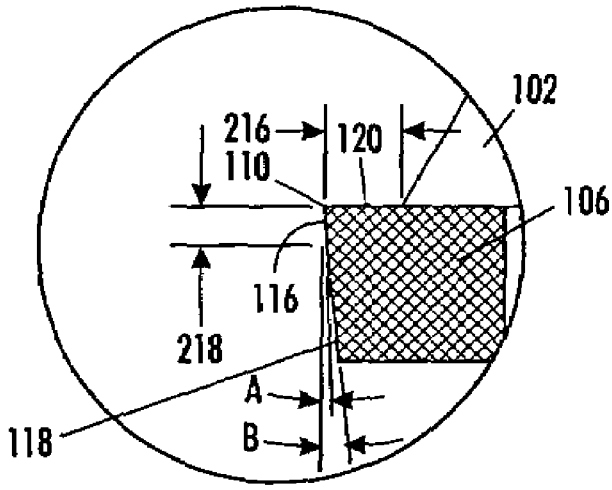
FIG. 2B is a detail view of the tip of the lathe tool shown in FIG. 2A.

FIG. 1B and FIG. 2B present top and side views, respectively, of the lathe tool's polycrystalline diamond cutting tip 106 mounted within lathe tool shank 102. As shown in FIG. 1B and FIG. 2B, cutting tip 106 is held within shank 102 such that a polycrystalline diamond tip cutting edge 110 is oriented as an outer-most surface of the lathe tool.

As shown in FIG. 2B, cutting edge 110 of cutting tip 106 may be formed by table face 120 and land face 116. The height 218 of land face 116 may be any height, however, a land height between 0.5 mm to 2.54 mm is preferred. The height of front clearance face 118 is not critical. Land angle "A" may be any angle between 1° and 8°, however, a preferred land angle of 2° is preferred. Front clearance angle "B" is not required, but is prefered. Front clearance angle "B" may be any angle between 2° (i.e., no additional clearance) and 30° , however, a front clearance angle of 7° is preferred. Table width 216 of table surface 120 may be any dimension, however, a table width of 0.9 mm is preferred. Table clearance angle "D" may be any angle, however, a table clearance angle of 30° is preferred.

The overall width 212 (See FIG. 1B) of cutting edge 110 may be any dimension and may be determined by the maximum overall width of the lathe tool shank which provides structural support to the polycrystalline diamond material that forms the cutting tip. For example, in one representative embodiment the width 212 of cutting edge 110 may be 3.5 mm. A side clearance angle "C" determines the angular dimensions of cutting edge point 112 formed by cutting edge 110 and non-cutting edge 114. As explained below, cutting edge point 112 and non-cutting edge 114 do not come into contact with the aluminum substrate surface during the turning process. Side clearance angle "C", therefore, is not critical. In one exemplary embodiment, side clearance angle "C" is 45°, resulting in an inside angle between cutting edge 110 and non-cutting edge 114 (i.e., cutting edge point 112) of 135°.

Figure 3:
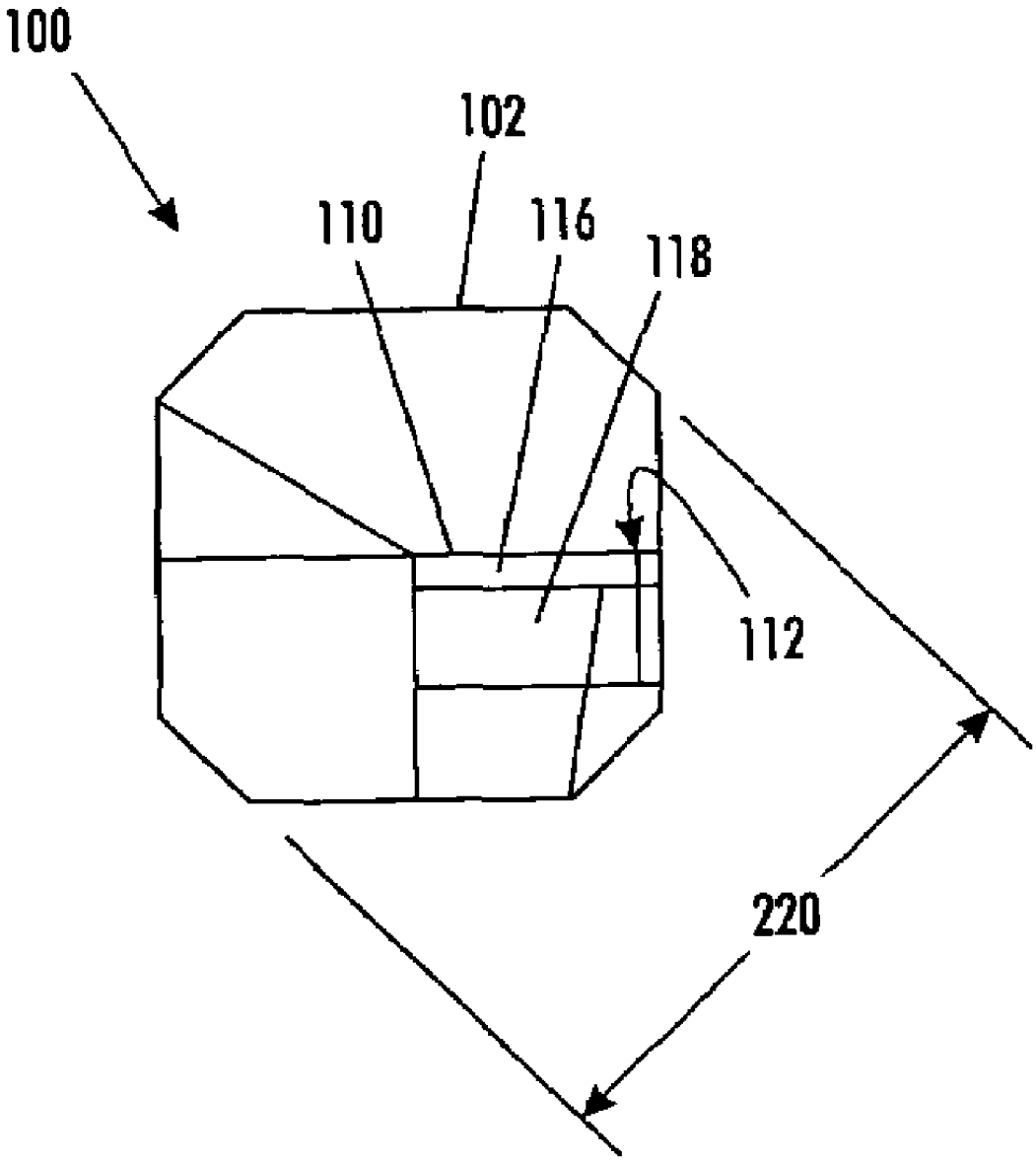
FIG. 3 is a front elevation view of the exemplary polycrystalline diamond-tipped cutting tool shown in FIG. 1A.

FIG. 3 presents a front elevation view of the cutting tip side of lathe tool 100 (i.e., the face opposite rear face 205 ). FIG. 3 shows and exemplary relationship of cutting edge 110, cutting edge point 112, land face 116, and relief face 118 with respect to lathe tool shank 102. The diagonal dimensions of lathe tool shank 102 are not limited to any specific size. In one exemplary embodiment the diagonal dimension 220 of lathe tool shank 102 (i.e., the dimension from one beveled corner face to the to the beveled face of the opposite corner) is 9.4 mm.

A photoreceptor substrate may be produced using a lathing process based on the following conditions. For example, the surface of a substrate may be turned by a polycrystalline diamond cutting tool, as described above. The substrate surface may be supplied with a suitable cutting liquid during the lathing process to facilitate cutting and to control surface temperatures of the cutting tool and the substrate surface. Then, the substrate may be cleaned, dried, and allowed to sit at ambient temperature to form an oxidation layer over the roughened surface. Thus, a roughened, oxidized substrate may be obtained for use within a electrophotographic photoreceptor.

(1) Substrate—As a substrate made of an aluminum alloy material, the rotary-drum-shaped substrate made of standard, commercially available 6063 Aluminum allow. For example, the 6063 aluminum alloy substrate may contain, in addition to aluminum, 0.45-0.9% by weight of magnesium, 0.2-0.6% by weight of silicon, 0.35% by weight of iron, 0.1% by weight of titanium, 0.1% by weight of zinc and 0.1% by weight or less of manganese. The rotary-drum-shaped substrate may have any outside diameter and any length. For example, one exemplary photoreceptor aluminum drum substrate may have a diameter of approximately 30 mm and a length of 240 mm. The described surface roughening technique, however, may be applied to a substrate of any diameter and any length.

(2) Cutting Liquid—Any kerosene based or aqueous based cutting solution may be used that is compatible with aluminum.

(3) Rotational Speed—The process described here is compatible with any commercially available lathe. Any lathe rotational speed may be used so long as the linear feed rate of the substrate in relation to the rotational speed of lathe results in a linear feed rate of between 0.002 inches and 0.010 inches per complete revolution of the substrate. Preferably the feed rate relative to the rotational speed of the substrate is .0045 inches per complete revolution of the substrate.

(4) Cutting Tool—A cutting tool that is made of polycrystalline diamond as desribed above with respect to FIGS. 1A, 1B, 2A, 2B and 3 may be used.

(5) Depth of Cut—The depth of cut may vary from a slight skim cut to a more substantial cut. For example, the depth of cut may vary from .005 mm to 0.3048 mm. However, a depth of cut of 0.0254 mm is preferred.

(6) Orientation of Cutting Tool—In preparation for the lathing process, the polycrystalline diamond tip lathe tool is positioned in the lathe such that the cutting edge 110 is facing the rotating surface of the aluminum drum substrate. With reference to FIGS. 2A and 2B, the lathe tool is positioned such that the rotating surface of the aluminum drum substrate moves in the direction indicated by arrow "G" relative to cutting edge 110. Further, with reference to FIGS. 1A and 1B, the lathe tool is positioned such that the direction of linear feed of the lath tool cutting edge tip 112 relative to the aluminum drum substrate is in the direction indicated by arrow "F."

The lathe tool is positioned, as described above, such that cutting edge 110 is opposite, and aligned in parallel with, the outermost point (or centerline) of the aluminum substrate drum. Once positioned in such a manner, the lathe tool is rotated about axis 104 (See FIG. 1A) in the direction indicated by arrow "F" such that cutting edge point 112 (See FIG. 1B) is below the centerline of the substrate. In other words, cutting edge 110 is oriented with negative shear relative to the aluminum drum. The amount of negative shear may vary from 3° rotation off the centerline to 45° rotation off the centerline, however, 30° of rotation is preferred.

Please note that by orienting the lathe tool with negative shear, as described above, lath tool cutting edge tip 112 and non-cutting edge 114 do not come into contact with the aluminum substrate. All cutting is performed by cutting edge 110.

Figure 4:
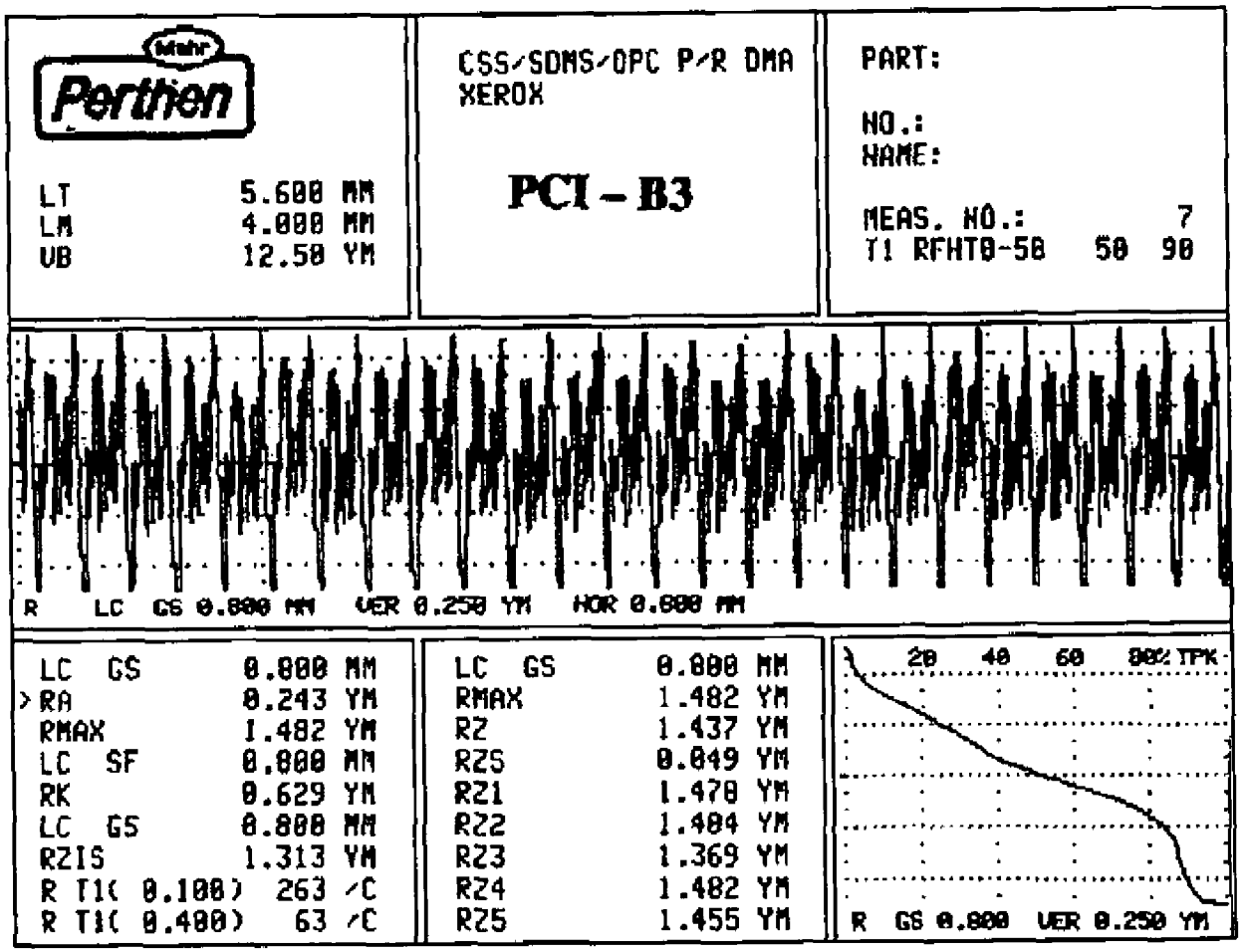
FIG. 4 and FIG. 5 are surface roughness profiles of exemplary photoreceptor substrate drums manufactured as described below.
Figure 5:
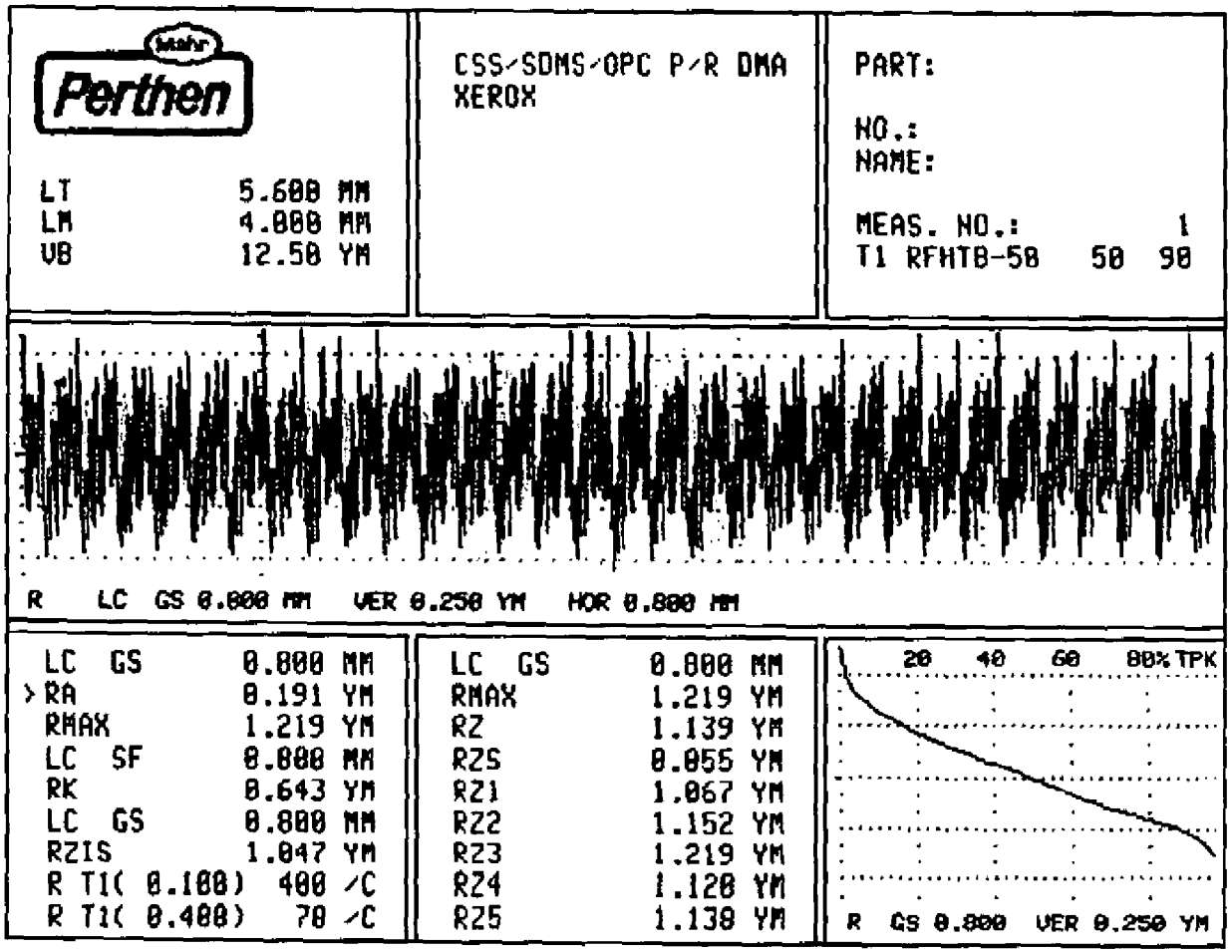

Using a polycrystalline diamond-tipped lathe tool, as described above, in the manner described above, multiple electrophotographic photoreceptor substrates were lathed on each of eleven different lathes and subjected to surface and operational printing tests, as described above. FIG. 4 presents a first exemplary surface roughness profile 300 for a first exemplary photoreceptor substrate drum surface created using the process described above. FIG. 5 presents a second exemplary surface roughness profile 400 for a second exemplary photoreceptor substrate drum surface created using the process described above. As shown in FIGS. 4 and 5, the exemplary photoreceptor substrate drums meet the specified surface roughness characteristics, described above. Further, when these roughened photoreceptor substrates were fabricated into multi-layered photoreceptors, as described above, the xerographic printers in which they were installed produced print output substantially free of distortions due to axial streaking in the undercoat film.

Please note that the counts in FIGS. 4 and 5 for $R_t$ (0.100) and $R_t$ (0.400) are on a per centimeter basis, whereas the physical evaluation length used by the evaluation device is only 0.8 mm. The count values provided for R. (0.100) and $R_t$ (0.400) presented in FIGS. 4 and 5 are extrapolated values based upon actual counts made over the physical 0.8 mm evaluation length.

Once a photoreceptor substrate is processed to include the surface roughness and oxidation characteristics described above, a photosensitive imaging member may be fabricated upon the prepared substrate. Any suitable technique may be utilized to apply the charge generating material (CGL) and a charge transport material (CTL) onto the substrate surface either in a laminate type configuration or in a single layer configuration. Typical application techniques include spraying, dip coating, roll coating, wire wound rod coating, and the like. Dip coating is a preferred coating technique where the dipping and raising motions of the substrate relative to the coating solution may be accomplished at any suitable speed. Drying of the deposited coating may be effected by any suitable conventional technique such as oven drying, infra-red radiation drying, air drying and the like. Generally, the thickness of the charge generating layer may range from about 0.1 μm to about 3 μm and the thickness of the transport layer may range between about 5 μm to about 100 μm, but thicknesses outside these ranges may also be used. In general, the ratio of the thickness of the charge transport layer to the charge generating layer is preferably maintained from about 2:1 to 200:1 and in some instances as great as 400:1.

A charge generating layer (CGL) and a charge transport layer (CTL) may be deposited onto the substrate surface either in a laminate type configuration where the CGL and CTL are in different layers or in a single layer configuration where the CGL and CTL are in the same layer along with a binder resin. When applied as different layers, the CTL in a charge transport layer may be applied to the substrate surface prior to or subsequent to application of the CGL in a charge generating layer. Typical organic photoconductive charge generating materials include, for example, azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, titanyl phthalocyanine, hydroxy gallium phthalocyanine and the like; quinacridone pigments; or azulene compounds. Typical inorganic photoconductive charge generating materials include, for example, cadmium sulfide, cadmium sulfoselenide, cadmium selenide, crystalline and selenium, lead oxide and other chalcogenides.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

Any suitable charge transport material may be used. Typical charge transport materials include, for example, organic polymer or non-polymeric material capable of supporting the injection of photoexcited holes or transporting electrons from the photoconductive material and allowing the transport of these holes or electrons through the organic layer to selectively dissipate a surface charge. Typical charge transport materials include, for example, a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, hydrazone compounds, and the like. Other typical transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly(N-vinylcarbazole); poly(vinylpyrene); poly(vinyltetraphene); poly(vinyltetracene), poly(vinylperylene), and the like. Typical electron transport materials include, for example, electron acceptors such as 2,4,7-trinitro-9-fluorenone; 2,4,5,7-tetranitro-fluorenone; dinitroanthracene; dinitroacridene; tetracyanopyrene, dinitroanthraquinone, and the like.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Weight average molecular weights may vary, for example, from about 20,000 to about 1,500,000.

Any suitable substrate may be treated including metal substrates typically employed as photoreceptor substrates such as those fabricated from for example stainless steel, nickel, aluminum, and alloys thereof. However, aluminum or aluminum alloy substrates are preferred. Typical aluminum alloys include, for example, 1050, 1100, 3003, 6061, 6063, and the like. Alloy 3003 contains Al, 0.12 percent by weight Si, 0.43 percent by weight Fe, 0.14 percent by weight Cu, 1.04 percent by weight Mn, 0.01 percent by weight Mg, 0.01 percent by weight Zn, 0.01 percent by weight Ti, and a trace amount of Cr. The size and distribution of inclusions and intermetallic compounds in the alloy should be below the level at which the inclusions and intermetallic particles would pose a problem for the lathing process. Patches of non-uniform surface texture may result if many large inclusions or intermetallics are present. Similarly, the ductility properties of the aluminum substrate should be substantially uniform to ensure a uniform texture upon completion of the lathing process. Generally, the surface of the substrate may be relatively smooth prior to lathing. Sufficiently smooth surfaces may be formed by, e.g., rough lathing, specialized extrusion and drawing processes, grinding, buffing and the like.

The detailed description has been provided with reference to preferred embodiments thereof, which are intended to be illustrative, not limiting. Various changes may be made and may be apparent to those of ordinary skill in the art without departing from the spirit and scope of the following claims.

What is claimed is:

1. A multi-layered photoreceptor comprising:

a roughened substrate having an average roughness ($R_a$) of about 0.080-0.200 μm, no fewer than about 200 peaks and valleys over a 0.8 mm length with a peak to valley distance of at least about 0.100 μm, and about 0 peaks and valleys over a 0.8 mm length with a peak to valley distance of at least about 0.400 μm;

an oxidation layer formed on the roughened substrate;

an undercoat film formed on said substrate;

a charge generating layer formed over the undercoat film; and a charge transport layer overlaying said charge generating layer, wherein said multi-layered photoreceptor is suitable for use in xerographic printers capable of producing print output substantially free of distortions due to axial streaking in the undercoat film.

2. The photoreceptor according to claim 1, wherein said substrate peaks and valleys have a maximum roughness value ($R_{max}$) of no greater than about 4.0 μm.

3. The photoreceptor according to claim 1, wherein said peaks and valleys have a maximum roughness value ($R_{max}$) of no greater than about 1.0 μm.

4. The photoreceptor according to claim 1, wherein said undercoat film is free of distortions caused by variances in the surface energy of the substrate.

5. The photoreceptor according to claim 1, wherein the peaks and valleys are diamond lathed on the substrate.

6. The photoreceptor according to claim 1, wherein said undercoat film on said substrate has a thickness of approximately 0.05 μm to 2.0 μm.

7. The photoreceptor according to claim 6, wherein said undercoat film has a thickness of approximately 0.05 μm to 1.0 μm.

8. The photoreceptor according to claim 1, wherein said oxidation layer covers substantially 100% of the roughened substrate surface.

9. A method of making a photoreceptor having a multi-layered structure including a substrate and an undercoat film covering said substrate, said method comprising:

forming peaks and valleys in the substrate to have an average roughness ($R_a$) of about 0.080-0.200 μm;

forming no fewer than about 200 of said peaks and valleys over a 0.8 mm length with a peak to valley distance of at least about 0.100 μm, and about 0 peaks and valleys over a 0.8 mm length with a peak to valley distance of at least about 0.400 μm;

forming an oxidation layer over the substrate;

coating the substrate with said undercoat film;

forming a charge generating layer over said undercoat film; and forming a charge transport layer over said charge generating layer, wherein said multi-layered photoreceptor is suitable for use in xerographic printers capable of producing print output substantially free of distortions due to axial streaking in said undercoat film.

10. The method according to claim 9, wherein said forming of peaks and valleys includes forming said peaks and valleys to have a maximum roughness value ($R_{max}$) of no greater than about 4.0 μm.

11. The method according to claim 9, wherein said forming of peaks and valleys includes forming said peaks and valleys to have a maximum roughness value ($R_{max}$) of no greater than about 1.0 μm.

12. The method according to claim 9, wherein said forming peaks and valleys, said forming the oxidation layer and said coating of the substrate with the undercoat film further comprise eliminating distortions in the undercoat film caused by variances in the surface energy of the substrate.

13. The method according to claim 9, wherein said forming of peaks and valleys includes diamond lathing the substrate.

14. The method according to claim 9, wherein said coating includes coating said undercoat film on said substrate with a thickness of approximately 0.05 μm to 2.0 μm.

15. The method according to claim 14, wherein said undercoat film has a thickness of approximately 0.05 μm to 1.0 μm.

16. The method according to claim 9, wherein said undercoat film comprises one of an organometallic compound and an organometallic chelate compound with a silane.

17. The method according to claim 16, wherein said undercoat film comprises an undercoat film substantially without a thickening agent.

* * * * *